US011162227B2

(12) United States Patent
Xiao et al.

(10) Patent No.: US 11,162,227 B2
(45) Date of Patent: Nov. 2, 2021

(54) BOLTLESS FASTENER ASSEMBLY FOR HEAVY HAUL RAILWAY WITH AXLE LOAD OF 35-40 TONS

(71) Applicants: CHINA ACADEMY OF RAILWAY SCIENCES CORPORATION LIMITED RAILWAY ENGINEERING RESEARCH INSTITUTE, Beijing (CN); CHINA ACADEMY OF RAILWAY SCIENCES CORPORATION LIMITED, Beijing (CN)

(72) Inventors: Junheng Xiao, Beijing (CN); Hangwei Fang, Beijing (CN); Zirui Li, Beijing (CN); Yanshan Li, Beijing (CN); Chengliang Li, Beijing (CN); Haoyong Yu, Beijing (CN); Liangshan Xu, Beijing (CN); Zhen Pan, Beijing (CN)

(73) Assignees: CHINA ACADEMY OF RAILWAY SCIENCES CORPORATION LIMITED RAILWAY ENGINEERING RESEARCH INSTITUTE, Beijing (CN); CHINA ACADEMY OF RAILWAY SCIENCES CORPORATION LIMITED, Beijing (CN)

( * ) Notice: Subject to any disclaimer, the term of this patent is extended or adjusted under 35 U.S.C. 154(b) by 0 days.

(21) Appl. No.: 17/051,789

(22) PCT Filed: Jun. 5, 2018

(86) PCT No.: PCT/CN2018/090001

§ 371 (c)(1),
(2) Date: Oct. 30, 2020

(87) PCT Pub. No.: WO2019/227515

PCT Pub. Date: Dec. 5, 2019

(65) Prior Publication Data

US 2021/0230809 A1 Jul. 29, 2021

(30) Foreign Application Priority Data

May 31, 2018 (CN) ..... 201810554553.X

(51) Int. Cl.
*E01B 9/30* (2006.01)
*E01B 9/68* (2006.01)

(52) U.S. Cl.
CPC ..... *E01B 9/303* (2013.01); *E01B 9/681* (2013.01)

(58) Field of Classification Search
CPC ..... E01B 9/00; E01B 9/02; E01B 9/28; E01B 9/30; E01B 9/303; E01B 9/60; E01B 9/62; E01B 9/68; E01B 9/681
See application file for complete search history.

(56) References Cited

U.S. PATENT DOCUMENTS 4,566,631 A * 1/1986 Brown ..... E01B 9/303 238/338
4,757,945 A * 7/1988 Leeves ..... E01B 9/686 238/107

(Continued)

FOREIGN PATENT DOCUMENTS

CN 201082943 Y 7/2008
CN 202202214 U 4/2012
CN 202925387 U 5/2013

(Continued)

*Primary Examiner* — Robert J McCarry, Jr.
(74) *Attorney, Agent, or Firm* — Bayramoglu Law Offices LLC

(57) ABSTRACT

A boltless fastener assembly for a heavy haul railway with an axle load of 35-40 tons includes a pre-embedded steel holder, an e-clip, an insulated gauge block and a rubber pad. A clamping leg-heel end of the e-clip is provided with an L-shaped retaining end. The pre-embedded steel holder is (Continued)

improved to adapt to the e-clip, and an opening is formed at a portion of the pre-embedded steel holder close to the clamping leg-heel end of the e-clip, so that the e-clip can be installed normally. During normal installation, the L-shaped retaining end of the e-clip does not contact the pre-embedded steel holder. When the rail undergoes large torsional deformation, the L-shaped retaining end on one side of a rail moves upward to contact an upper edge of the opening of the pre-embedded steel holder or engages with a second heel end.

2 Claims, 2 Drawing Sheets

(56) References Cited

U.S. PATENT DOCUMENTS

| | | | | |
|---|---|---|---|---|
| 5,678,762 | A * | 10/1997 | Wood | E01B 9/303 238/351 |
| 6,343,748 | B1 * | 2/2002 | Pilesi | E01B 9/303 238/310 |
| 6,517,008 | B1 | 2/2003 | Remington et al. | |
| 2007/0210179 | A1 * | 9/2007 | Young | E01B 9/303 238/351 |
| 2008/0203181 | A1 * | 8/2008 | Young | E01B 9/303 238/351 |

FOREIGN PATENT DOCUMENTS

| | | | |
|---|---|---|---|
| CN | 205443810 | U | 8/2016 |
| CN | 208792059 | U | 4/2019 |
| DE | 4240347 | A1 | 6/1994 |

* cited by examiner

BOLTLESS FASTENER ASSEMBLY FOR HEAVY HAUL RAILWAY WITH AXLE LOAD OF 35-40 TONS

CROSS REFERENCE TO THE RELATED APPLICATIONS

This application is the national phase entry of International Application No. PCT/CN2018/090001, filed on Jun. 5, 2018, which is based upon and claims priority to Chinese Patent Application No. 201810554553.X, filed on May 31, 2018, the entire contents of which are incorporated herein by reference.

TECHNICAL FIELD

The present invention relates to a clip fastening system used in rails, and more particularly, to a boltless fastener assembly for a heavy haul railway with an axle load of 35-40 tons.

BACKGROUND

Heavy haul railway transportation features large carrying capacity, high efficiency and low transportation cost and thus has widespread use throughout the world. The United States, Canada, Brazil, Australia and South Africa have operated a large number of heavy haul trains on heavy haul railways, and Europe has begun to run heavy haul trains on mixed passenger and freight lines dominated by passenger transport. As one of the important components of the track structure, fasteners play an important role in maintaining the gauge and enhancing the stability of the track structure.

Boltless fasteners have a simple structure and do not need to lubricate bolts and tighten nuts. Boltless fasteners have in large part mechanized operations and greatly reduced installation and maintenance work. Boltless fasteners are mostly preferred, especially in developed countries with high human resource costs. Boltless fasteners used in heavy haul railways, ordinary-speed railways and high-speed railways at home and abroad have the above-mentioned advantages, but also have several obvious drawbacks. The bolted rail undergoes significant torsional deformation caused by a large lateral load, because the e-clip has no secondary clamping stiffness or a stop device to limit and prevent excessive deformation. This deficiency in the e-clip typically results in substantial residual deformation of the clip and loss of the clamping force. Therefore, the clip is prone to failure in large lateral load resistance tests performed as per the standards of American Railway Engineering and Maintenance-of-Way Association (AREMA).

SUMMARY

In order to solve the above technical problems, the present invention provides a boltless fastener assembly for a heavy haul railway. The assembly is designed to have application for a heavy haul railway with an axle load of 35-40 tons.

To solve the technical problems, the present invention adopts the following technical solutions.

A boltless fastener assembly suitable for a heavy haul railway with an axle load of 35-40 tons includes a pre-embedded steel holder, an e-clip, an insulated gauge block and a rubber pad. The pre-embedded steel holder is embedded when a concrete sleeper is prepared. A second heel end of the e-clip is inserted into the pre-embedded steel holder to clamp a rail. The insulated gauge block is provided between the pre-embedded steel holder and the rail. The rubber pad is provided between the rail and a rail bearing surface of the concrete sleeper. A clamping leg-heel end of the e-clip is provided with an L-shaped retaining end. An opening is formed at a portion of the pre-embedded steel holder close to the clamping leg-heel end of the e-clip. The L-shaped retaining end extends into the opening.

Further, the L-shaped retaining end is provided with a contact tooth groove at one end.

Further, the second heel end is provided with a groove adapted to the L-shaped retaining end.

Further, the tooth groove at one end of the L-shaped retaining end and the groove of the second heel end are engaged in the pre-embedded steel holder.

Further, the boltless fastener assembly is suitable for a heavy haul railway with an axle load of 35-40 tons.

Further, during normal installation, the L-shaped retaining end of the e-clip does not contact the pre-embedded steel holder, thereby not affecting the normal installation and stress of the e-clip. When the rail undergoes large torsional deformation, the L-shaped retaining end on one side of the rail moves upward to contact an upper edge of the opening of the pre-embedded steel holder, resulting in large resistance to prevent the rail from torsional deformation, thereby preventing the e-clip from failure due to excessive deformation.

Further, when large torsional deformation occurs on the rail, the L-shaped retaining end on one side of the rail engages with the second heel end to generate large resistance to prevent the rail from torsional deformation, thereby preventing the e-clip from failure due to excessive deformation.

When the rail undergoes significant torsional deformation due to a large lateral load, because the e-clip of the existing boltless fastener has no secondary clamping stiffness or a limit device to prevent excessive deformation, it is easy to cause the residual deformation of the clip to be too large and lose the clamping force. Therefore, the clip is prone to failure in large lateral load resistance tests performed as per the standards of American Railway Engineering and Maintenance-of-Way Association (AREMA). The present invention improves the design of the clip and the pre-embedded steel holder on the basis of the prior art, so that the fastener can resist excessive torsional deformation of the rail. During normal installation, the L-shaped retaining end does not contact the pre-embedded steel holder, thereby not affecting the normal installation and stress of the clip. When the rail undergoes large torsional deformation, the L-shaped retaining end on one side of the rail moves upward to contact an upper edge of the opening of the pre-embedded steel holder or engages with a second heel end. In this way, large resistance is generated to prevent the rail from torsional deformation, thereby preventing the clip from failure due to excessive deformation. The present invention is particularly suitable for a heavy haul railway with an axle load of 35-40 tons.

DETAILED DESCRIPTION OF THE EMBODIMENT

Figure 1:
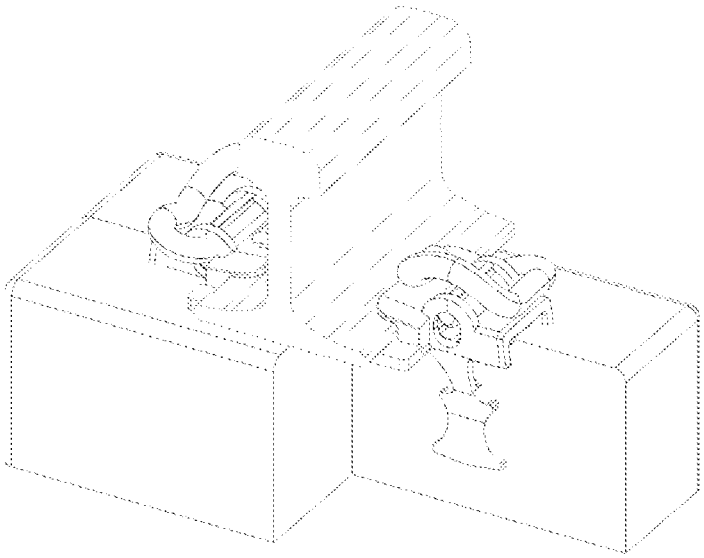
FIG. 1 (Prior art)
FIG. 1 is a structural diagram of a prior art boltless fastener.
Figure 2:
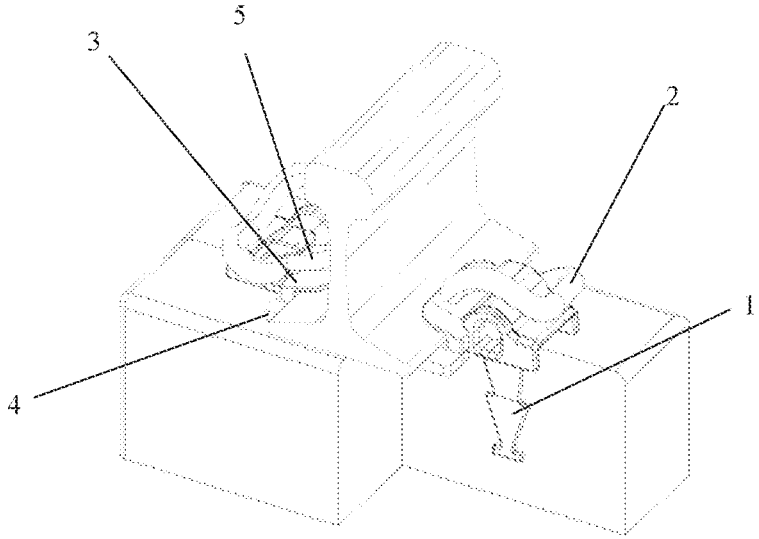
FIG. 2 is a structural diagram of an embodiment of the boltless fastener of the invention.
Figure 3:
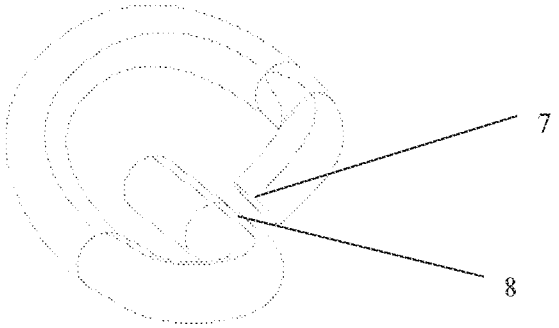
FIG. 3 is a structural diagram of an embodiment of the clip of the invention.
Figure 4:
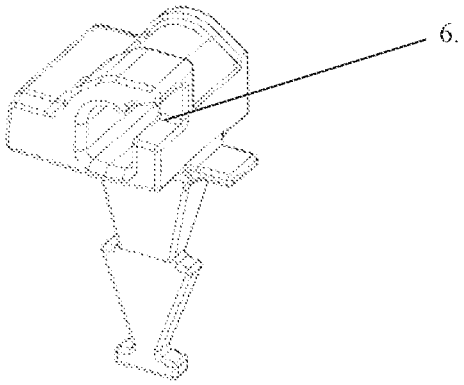
FIG. 4 is a structural diagram of an embodiment of the pre-embedded steel holder of the invention.
Figure 5:
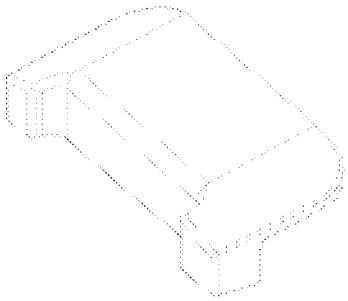
FIG. 5 is a structural diagram of an embodiment of the insulated gauge block of the invention.

To clearly illustrate the technical solution, creative features, objectives and effects of the present invention, the invention is further described hereinafter with reference to the drawings.

Embodiment 1

A boltless fastener assembly suitable for a heavy haul railway with an axle load of 35-40 tons includes the pre-embedded steel holder 1, the e-clip 2, the insulated gauge block 3 and the rubber pad 4. The pre-embedded steel holder 1 is embedded when a concrete sleeper is prepared. The e-clip 2 is inserted into the pre-embedded steel holder to clamp a rail. The insulated gauge block 3 is provided between the pre-embedded steel holder 1 and the rail. The rubber pad 4 is provided between the rail and a rail bearing surface of the concrete sleeper. A clamping leg-heel end of the e-clip 2 is provided with the L-shaped retaining end 7. The pre-embedded steel holder 1 is improved to adapt to the e-clip 2, and the opening 6 is adaptively formed at a portion of the pre-embedded steel holder 1 close to the clamping leg-heel end of the e-clip 2. The L-shaped retaining end 7 extends into the opening 6. The opening 6 is formed at a portion of the pre-embedded steel holder 1 close to the clamping leg-heel end of the e-clip 2, so that the e-clip 2 can be installed normally.

During normal installation, the L-shaped retaining end of the e-clip 2 does not contact the pre-embedded steel holder 1, thereby avoiding affecting the normal installation and stress of the e-clip 2. When the rail undergoes large torsional deformation, the L-shaped retaining end 7 on one side of the rail moves upward to contact an upper edge of the opening 6 of the pre-embedded steel holder, resulting in large resistance to prevent the rail from torsional deformation, thereby preventing the e-clip 2 from failure due to excessive deformation.

Embodiment 2

A boltless fastener assembly suitable for a heavy haul railway with an axle load of 35-40 tons includes the pre-embedded steel holder 1, the e-clip 2, the insulated gauge block 3 and the rubber pad 4. The pre-embedded steel holder 1 is embedded when a concrete sleeper is prepared. The e-clip 2 is inserted into the pre-embedded steel holder to clamp a rail. The insulated gauge block 3 is provided between the pre-embedded steel holder 1 and the rail. The rubber pad 4 is provided between the rail and a rail bearing surface of the concrete sleeper. A clamping leg-heel end of the e-clip 2 is provided with the L-shaped retaining end 7. The pre-embedded steel holder 1 is improved to adapt to the e-clip 2, and the opening 6 is adaptively formed at a portion of the pre-embedded steel holder 1 close to the clamping leg-heel end of the e-clip 2. The L-shaped retaining end 7 extends into the opening 6. The L-shaped retaining end 7 is provided with a contact tooth groove at one end, and the second heel end 8 is provided with an adaptive groove. The tooth groove at one end of the L-shaped retaining end 7 and the groove of the second heel end 8 contact are engaged in the pre-embedded steel holder 1. When large torsional deformation occurs on the rail, the L-shaped retaining end 7 on one side of the rail is engage with the second heel end 8 to generate large resistance to prevent the rail from torsional deformation, thereby preventing the e-clip 2 from failure due to excessive deformation.

For the purposes of promoting an understanding of the principles of the invention, specific embodiments have been described. It should nevertheless be understood that the description is intended to be illustrative and not restrictive in character, and that no limitation of the scope of the invention is intended. Any alterations and further modifications in the described components, elements, processes or devices, and any further applications of the principles of the invention as described herein, are contemplated as would normally occur to one skilled in the art to which the invention pertains.

What is claimed is:

1. A boltless fastener assembly for a heavy haul railway with an axle load of 35-40 tons, comprising a pre-embedded steel holder, an e-clip, an insulated gauge block and a rubber pad, wherein, the pre-embedded steel holder is embedded when a concrete sleeper is prepared; a second heel end of the e-clip is inserted into the pre-embedded steel holder to clamp a rail; the insulated gauge block is provided between the pre-embedded steel holder and the rail; the rubber pad is provided between the rail and a rail bearing surface of the concrete sleeper; a clamping leg-heel end of the e-clip is provided with an L-shaped retaining end; an opening is adaptively formed at a portion of the pre-embedded steel holder, and the portion is close to the clamping leg-heel end of the c-clip; and the L-shaped retaining end extends into the opening;

the L-shaped retaining end is provided with a contact tooth at one end;

the second heel end is provided with a groove adapted to the L-shaped retaining end;

during an installation, the L-shaped retaining end of the c-clip does not contact the pre-embedded steel holder, and does not affect the installation and stress of the e-clip;

when the rail undergoes large torsional deformation, the contact tooth at one end of the L-shaped retaining end and the groove of the second heel end are engaged in the pre-embedded steel holder to result in large resistance to prevent the rail from torsional deformation, and to prevent the e-clip from failure due to excessive deformation.

2. The boltless fastener assembly according to claim 1, wherein when the rail undergoes the large torsional deformation, the L-shaped retaining end on one side of the rail moves upward to contact an upper edge of the opening of the pre-embedded steel holder to result in the large resistance to prevent the rail from the torsional deformation, and to prevent the e-clip from the failure due to the excessive deformation.

* * * * *